US010876778B2

(12) United States Patent
Assouad

(10) Patent No.: US 10,876,778 B2
(45) Date of Patent: Dec. 29, 2020

(54) REFRIGERATION SYSTEM CONTROL AND PROTECTION DEVICE

(71) Applicant: Emilie Elie Kfoury Aswad, Athens (GR)

(72) Inventor: Bechara Philip Assouad, Beirut (LB)

(73) Assignee: EMILIE ELIE KFOURT ASWAD, Athens (GR)

( * ) Notice: Subject to any disclaimer, the term of this patent is extended or adjusted under 35 U.S.C. 154(b) by 110 days.

(21) Appl. No.: 16/091,158

(22) PCT Filed: Mar. 24, 2017

(86) PCT No.: PCT/GR2017/000015

§ 371 (c)(1),
(2) Date: Oct. 4, 2018

(87) PCT Pub. No.: WO2017/175014

PCT Pub. Date: Oct. 12, 2017

(65) Prior Publication Data

US 2020/0200458 A1 Jun. 25, 2020

Related U.S. Application Data

(60) Provisional application No. 62/319,335, filed on Apr. 7, 2016.

(51) Int. Cl.
*F25B 49/02* (2006.01)

(52) U.S. Cl.
CPC ..... *F25B 49/022* (2013.01); *F25B 2400/01* (2013.01); *F25B 2500/26* (2013.01);
(Continued)

(58) Field of Classification Search
CPC ..... F25B 49/022; F25B 2500/26; F25B 2500/28; F25B 2600/2513; F25B 2700/21151
See application file for complete search history.

(56) References Cited

U.S. PATENT DOCUMENTS 5,209,076 A 5/1993 Kauffman et al.
5,666,815 A 9/1997 Aloise
(Continued)

FOREIGN PATENT DOCUMENTS

EP 1647783 A2 4/2006
EP 2924366 A1 9/2015
(Continued)

OTHER PUBLICATIONS

International Search Report, PCT/GR2017/000015, dated Aug. 2, 2017 (3 pp.).
(Continued)

*Primary Examiner* — Marc E Norman
(74) *Attorney, Agent, or Firm* — Eversheds Sutherland (US) LLP

(57) ABSTRACT

A device to protect a compressor against liquid flooding, oil heater malfunction, low refrigerant charge, high superheat. The system includes a device that measures two temperatures separated by a heat source (the electric compressor or the suction heat exchanger or both). The temperature difference can detect a liquid return to the compressor, a high superheat, a low refrigerant charge or a crankcase heater malfunction and the temperature difference can control the electronic expansion valve.

15 Claims, 9 Drawing Sheets

Sensors installation in semi-hermetic compressors

(52) U.S. Cl.
CPC ..... *F25B 2500/28* (2013.01); *F25B 2600/23* (2013.01); *F25B 2600/2513* (2013.01); *F25B 2700/21151* (2013.01)

(56) References Cited

U.S. PATENT DOCUMENTS

| | | | | |
|---|---|---|---|---|
| 6,539,734 | B1 | 4/2003 | Weyna | |
| 6,578,373 | B1 | 6/2003 | Barbier | |
| 9,194,393 | B2 | 11/2015 | Pham | |
| 2002/0139133 | A1 | 10/2002 | Hwang | |
| 2004/0194485 | A1 | 10/2004 | Dudley | |
| 2012/0205088 | A1* | 8/2012 | Morisita | B60L 3/0061 165/202 |
| 2014/0308138 | A1* | 10/2014 | Pham | F04B 49/02 417/12 |

FOREIGN PATENT DOCUMENTS

| | | | |
|---|---|---|---|
| EP | 2933583 | A1 | 10/2015 |
| GB | 2157447 | A | 10/1985 |
| WO | 2012027241 | A1 | 3/2012 |
| WO | 2015045854 | A1 | 4/2015 |

OTHER PUBLICATIONS

International Preliminary Report on Patentability, PCT/GR2017/000015, dated Jul. 18, 2018 (23 pp.).

Laughman, C.R., et al., The Detection of Liquid Slugging Phenomena in Reciprocating Compressors via Power Measurements, International Compressor Engineering Conference, School of Mechanical Engineering, Purdue University, 2006 (9 pp.).

* cited by examiner

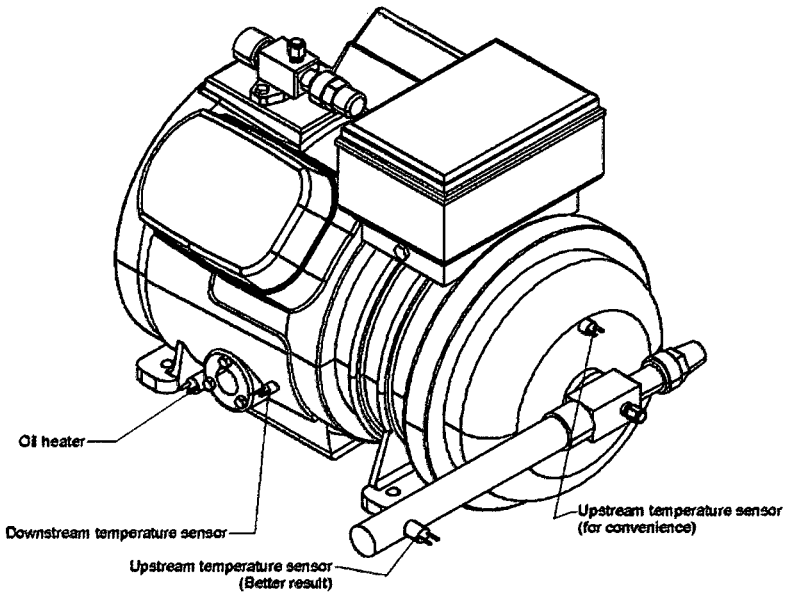
Figure 1, Sensors installation in semi-hermetic compressors

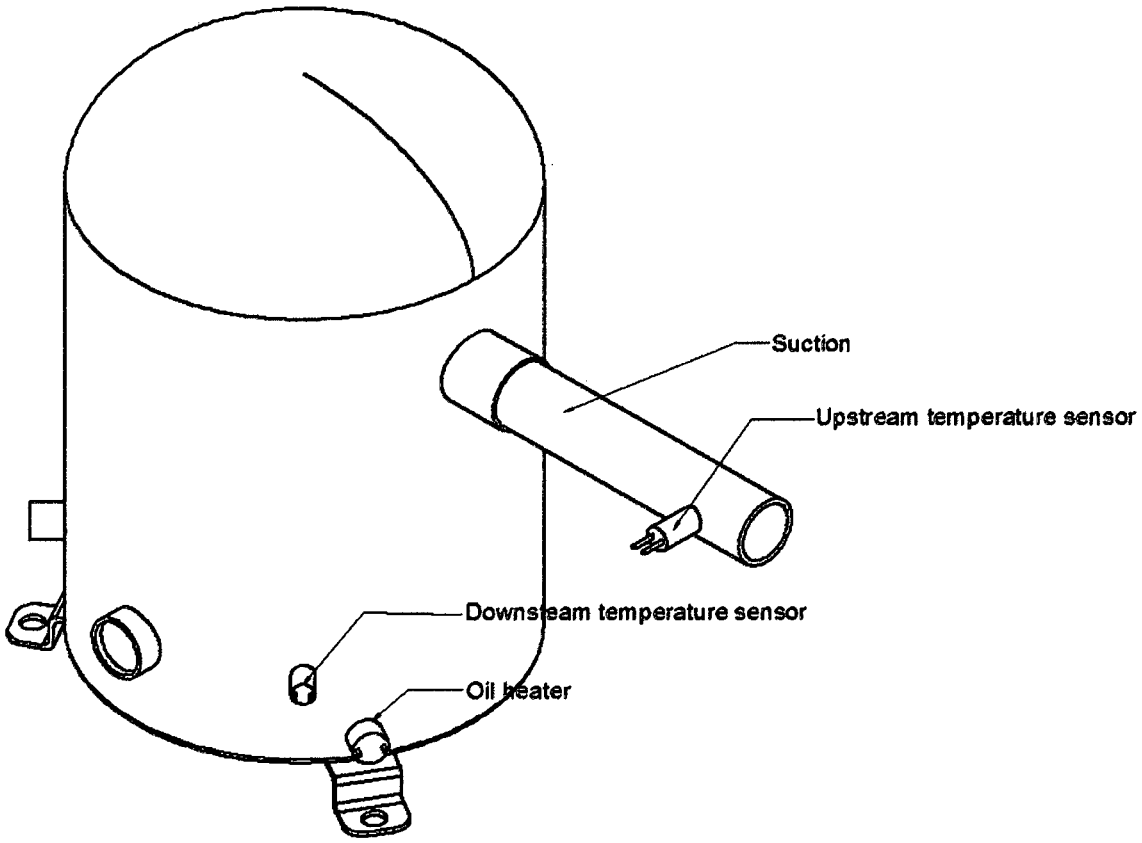
Figure 2, Sensors installation in a hermetic compressor

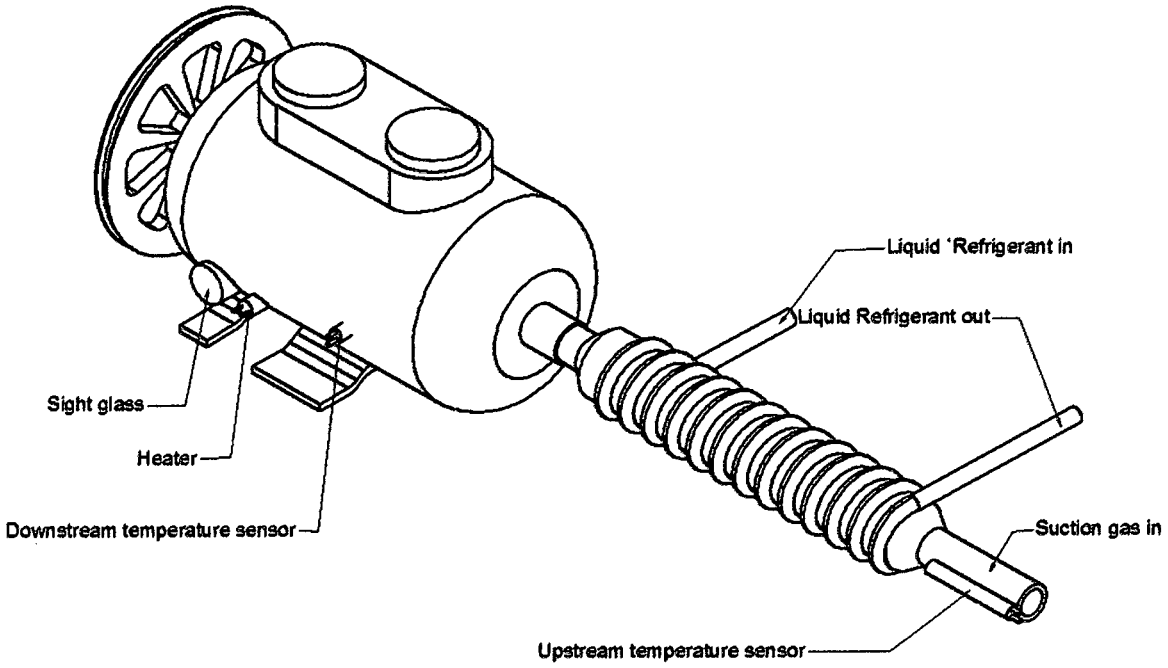
Figure 3, Sensors installation in an open compressor

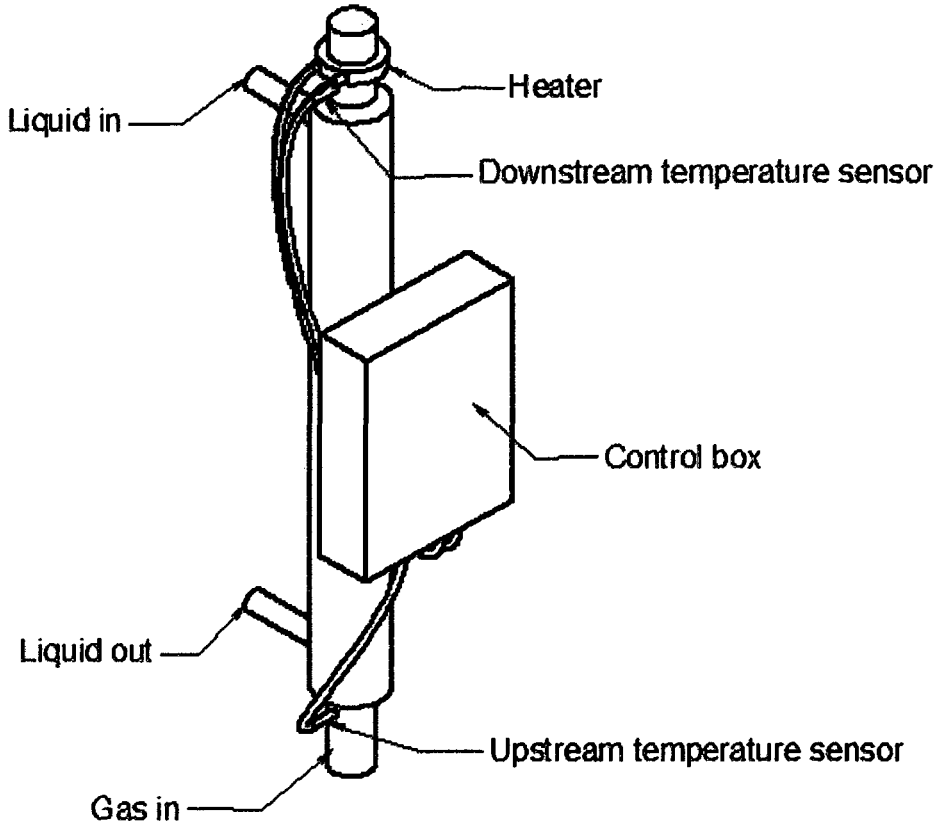
Figure 4, Suction gas heat exchanger for compressors w/o crankcase.

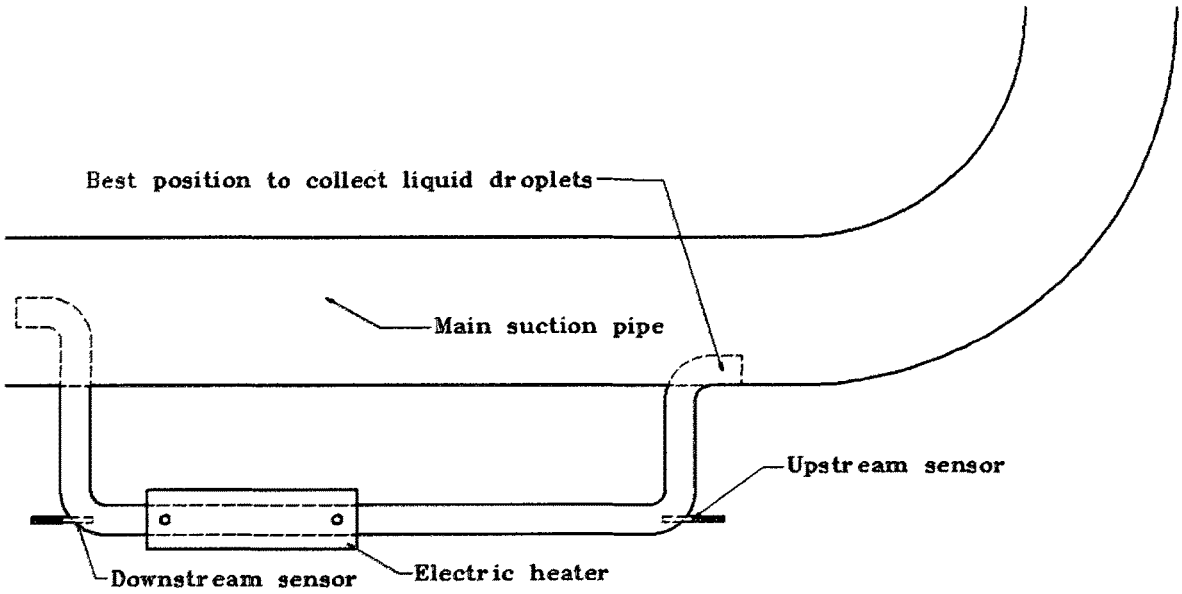
Figure 5, Parallel miniaturized suction gas heater with sensors.

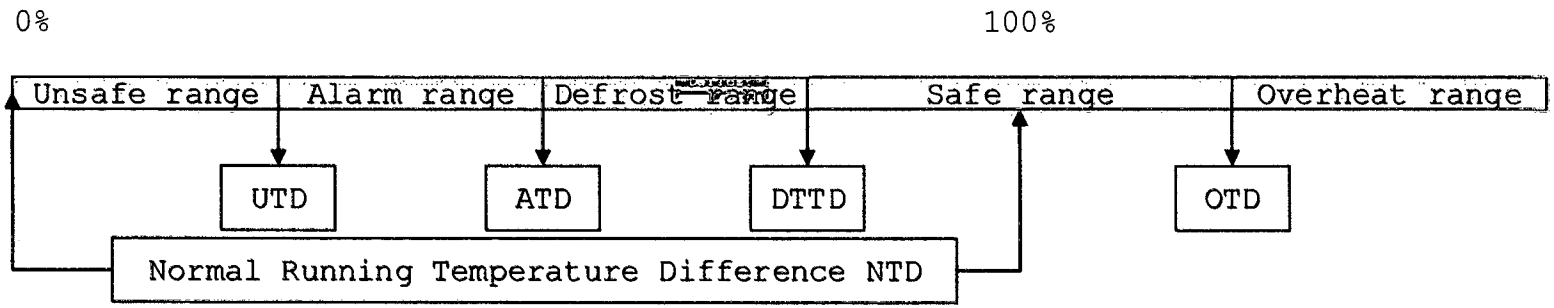

UTD: Unsafe temperature difference

ATD: Alarm temperature difference

DTTD: Defrost triggering temperature difference

OTD: Overheat temperature difference

MTDC: Minimum temperature difference for crankcase heater

DT: Measured difference in temperature

NTD: Normal temperature difference

MTBD: Minimum time between two defrost cycle

TSLD: Time since last defrost

EHT Extra heating time

DBCP Delay before checking parameters

Figure 6, Terms definitions and presentations

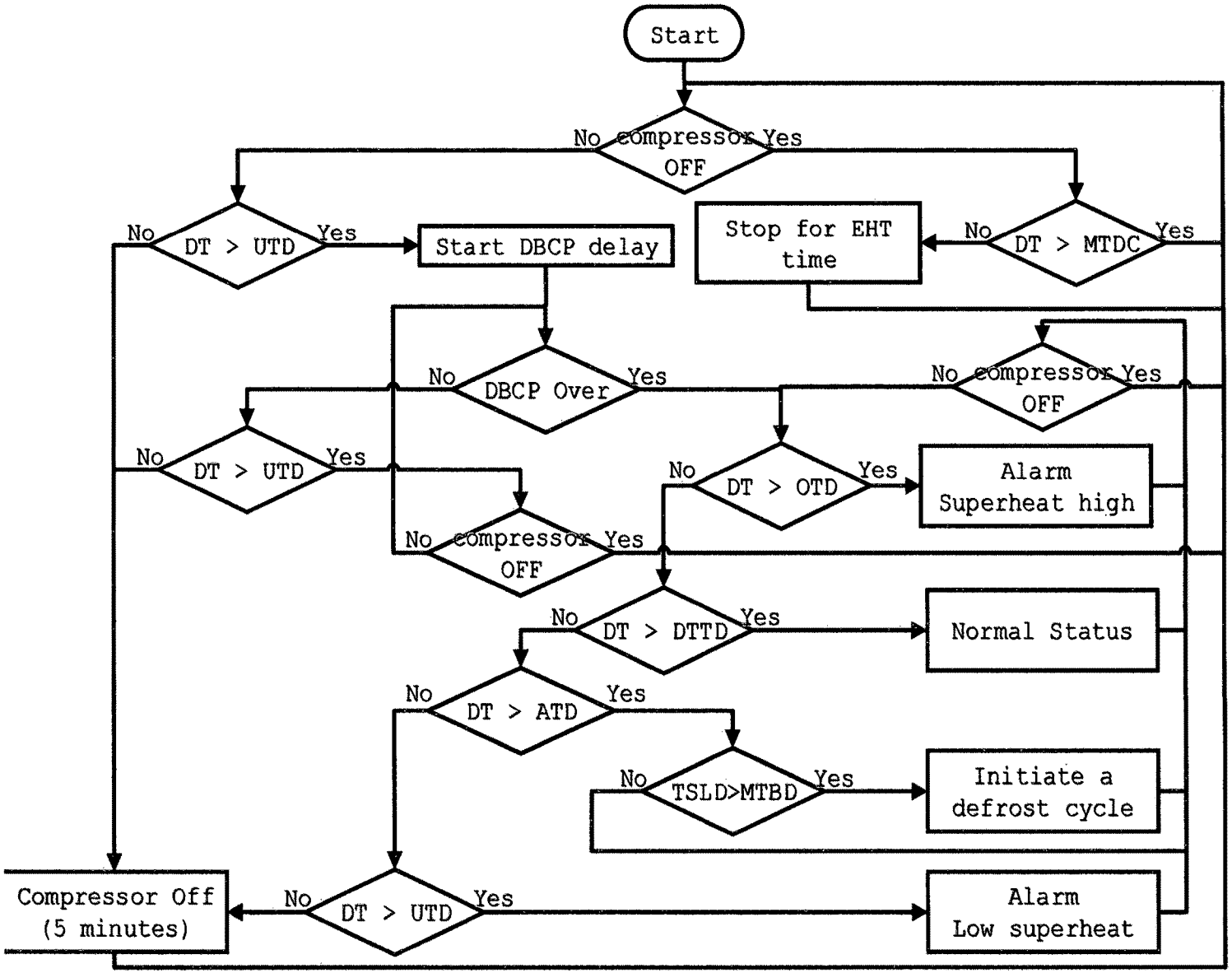
Figure 7, Example of control algorithm for the proposed invention

| | *Temperature / pressure range* | | | | | | | | | | | |
|---|---|---|---|---|---|---|---|---|---|---|---|---|
| | *Air conditioning* | | | | *Cold store* | | | | *Freezer* | | | |
| | Compressor cut-off | Alarm | Defrost | Excess superheat | Compressor cut-off | Alarm | Defrost | Excess superheat | Compressor cut-off | Alarm | Defrost | Excess superheat |
| **Semi-hermetic compressor** fitted with: | | | | | | | | | | | | |
| 70% electric motor efficiency | 3 | | | 15 | 5 | 6 | 10 | 20 | 5 | 8 | 12 | 25 |
| **80% electric motor** efficiency | 2 | | | 14 | 4 | 5 | 8 | 19 | 4 | 7 | 10 | 24 |
| **90% electric motor** efficiency | 1 | | | 13 | 3 | 4 | 7 | 18 | 3 | 6 | 9 | 22 |
| **Semi-hermetic** compressors with suction gas heat exchanger fitted with: | | | | | | | | | | | | |
| **70% electric motor** efficiency | 6 | 7 | | 20 | 6 | 8 | 10 | 24 | 6 | 10 | 12 | 27 |
| **80% electric motor** efficiency | 5 | 6 | | 17 | 5 | 7 | 9 | 23 | 5 | 9 | 11 | 25 |
| **90% electric motor** efficiency | 4 | 5 | | 15 | 4 | 6 | 8 | 22 | 4 | 8 | 10 | 23 |
| **Open compressor with** suction gas heat exchanger | 3 | 4 | | 13 | 3 | 4 | 8 | 20 | 3 | 6 | 10 | 23 |

Figure 8, Example of invention controller settings for semi-hermetic compressors

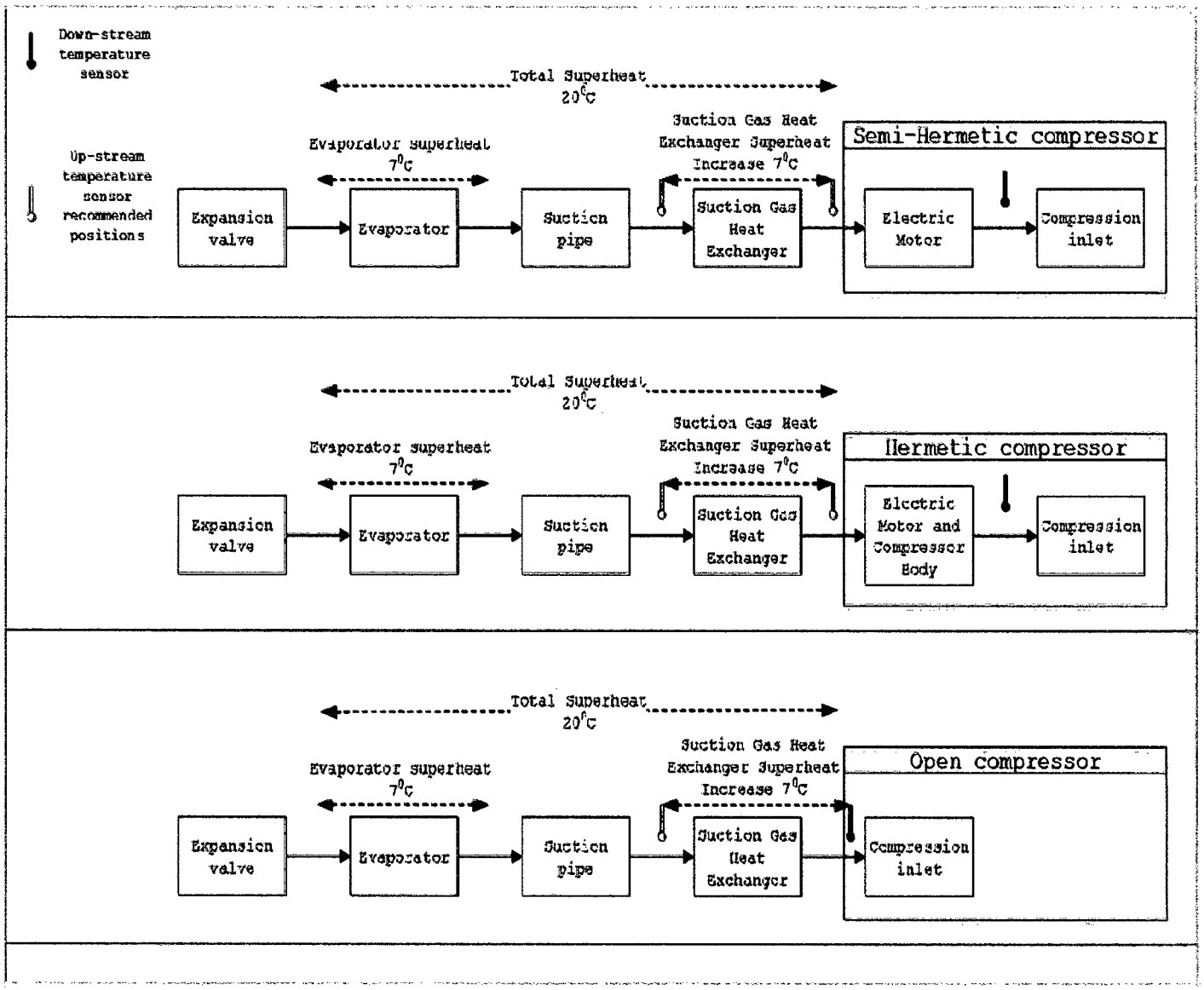
Figure 9, Upstream temperature sensors positions in different systems with temperature possibilities

REFRIGERATION SYSTEM CONTROL AND PROTECTION DEVICE

FIELD OF THE INVENTION

This invention is intended to protect and control a refrigeration system against liquid refrigerant return to the compressor, compressor crankcase heater malfunction and excessive superheat.

BACKGROUND OF THE INVENTION

On almost all refrigeration compressors there is no reliable control system installed capable of protecting the compressor against refrigerant liquid flooding or crankcase heater malfunction.

However, on some large compressors present in the market, there is a protection for liquid refrigerant flooding installed on the suction pipe next to the compressor (e.g. model HBCP manufactured by HB Products). This protection is based on two plates acting as a condenser and the capacitance varies when refrigerant droplets pass between the two plates. This system requires high precision electronics, and according to the manufacturer, it needs calibration and periodic maintenance and yearly recalibration.

Moreover, such systems are just detecting the superheat upstream of the compressor. Hence, in case of hermetic or semi-hermetic compressors, they do not take into account that if there are some droplets returning to the compressor, the droplets can evaporate during their passage through the electric motor and the compressor body and that in this particular case the is no need to stop the compressor.

Prior art also includes systems to protect the compressors from liquid surges by installing what is called a suction accumulator. This protection is good in preventing start-up surge, but a suction accumulator is not equipped to stop the compressor in case the liquid exceeds its accumulation capacity. (e.g. when the expansion valve is out of order, or in the case of a sudden reversing in a heat pump machine).

Other experimental systems have chosen to analyze the electric motor current and to try to detect the variations in the waveform. (e.g. spikes in the current can indicate liquid knocking inside the cylinder) while other systems have chosen to rely on the power absorption and to compare the theoretical power that the compressor should consume at the actual running conditions with the actual power of the compressor consumption. Both types of systems need sophisticated electronic controllers. These systems are either experimental or rarely used.

A study at Massachusetts Institute of Technology (C084) entitled: "The Detection of Liquid Slugging Phenomena in Reciprocating Compressors via Power Measurements", published at the International Compressor Engineering Conference at Purdue, Jul. 17-20, 2006. According to this study, detection is made by analyzing the electrical current flowing into the compressor and identifying the change in load on the motor caused by the presence of liquid in the compressor cylinder. The study concludes that "additional research into developing robust fault detection methods and extensive field tests are necessary to insure that these fault detection methods could produce reliable results in the field".

Prior art also includes a protection system named Bock Compressor Management BCM2000 which is a sophisticated system with a different concept of operation. For the crankcase heater, it checks in the oil temperature is greater than 25° C. and then considers that the heater is running properly. However, if the ambient temperature is greater than 25° C., the oil temperature will be greater than 25° C. even if the crankcase heater is faulty. In this case if the evaporator's temperature is higher than the crankcase temperature, refrigerant migration can occur and the refrigerant will mix with the oil.

The following are relevant patents disclosures related to the field of the invention:

U.S. Pat. No. 5,209,076 Describes a microprocessor based device which monitors the operation of a compressor in a refrigeration system and automatically shuts the compressor down if a monitored condition is abnormal. Sensors in the refrigeration system sense conditions such as refrigerant pressure and temperature, superheat, oil pressure and motor current draw. If a sensed condition is outside of a safety range and remains there for a time out period, an alarm condition is indicated and the device generates an alarm signal and shuts down the compressor. A detachable display module includes a keypad for carrying out field programming and a LCD screen for displaying the refrigerant conditions and programming prompts and commands. A reset button permits resetting twice before a service call is required. This device is very sophisticated and expensive and sensitive to line voltage fluctuations.

U.S. Pat. No. 6,578,373 Describes a flood back detector for refrigerant systems employing any of: minimum suction temperature, temperature rate of change and duration thereof; minimum superheat, superheat rate of change and duration thereof. This device is also sophisticated and expensive and needs extensive testing for every compressor model.

U.S. Pat. No. 9,194,393B2 Describes a system and a method for flooded start control of a compressor for a refrigeration system. A temperature sensor generates temperature data corresponding to at least one of a compressor temperature and an ambient temperature. A control module receives the temperature data, determines an off-time period since the compressor was last on, determines an amount of liquid present in the compressor based on the temperature data and the off-time period, compares the amount of liquid with a predetermined threshold, and, when the amount of liquid is greater than the predetermined threshold, operates the compressor according to at least one cycle including a first time period during which the compressor is on and a second time period during which the compressor is off. As above, this device is also sophisticated and expensive and needs extensive testing for every compressor model.

U.S. Pat. No. 6,539,734B1 According to this disclosure, when a flooded compressor in a refrigeration unit begins to run, refrigerant that has been absorbed into the oil is suddenly released, causing the crankcase to be filled with a sudsy mixture of refrigerant and oil. This mixture is then drawn into the suction manifold, cylinders, and compressor heads, in addition to being pumped out into the refrigeration system. When a flooded compressor startup condition in a mobile refrigeration unit is sensed, the compressor is shut down for a specified period of time to allow the oil in the system and on the compressor heads to drain back into the compressor oil sump before running the compressor again. The flooded compressor condition is determined by checking whether a suction superheat, a discharge superheat, and a suction pressure are all within specified operating parameters for a specified period of time after the compressor is started. As above this device needs extensive testing for each compressor model.

U.S. 20040194485A1, Describes two liquid levels that are sensed in the oil sump of a compressor to determine if sufficient oil and excess refrigerant are present prior to starting the compressor and appropriate steps taken, if necessary. Only the quantity of oil in the crankcase is monitored.

U.S. Pat. No. 5,666,815 Provides for an apparatus and method for storing the vapor pressure/temperature models for a number of refrigerants in the integral microprocessor, selecting the appropriate refrigerant, observing the desired system temperature and pressure, calculating the saturated temperature for the refrigerant selected, and subtracting the calculated temperature from the observed temperature. The disadvantages are the need of precise sensors, the need to enter tables for each refrigerant, it senses the flooding at compressor inlet, and it does not provide a protection for crankcase heater malfunction at the same time. It needs a timer to bypass the monitoring when the compressor starts.

U.S. Pat. No. 5,209,076 By observing a multitude of operational parameters including suction superheat, establishing a tolerable range for the parameters and shutting down the compressor in the event one or more of the observed parameters fall outside the pre-established limits. While the disclosure suggests the storage of a series of data points and presentation of 'trends', it does not suggest any particular action be taken with respect to the observed trends, nor, in particular does it suggest any immediate action be taken with respect to any particular rate function. The disadvantages are the need of precise sensors, the need to enter tables for each refrigerant, it senses the flooding at compressor inlet, and it does not provide a protection for crankcase heater malfunction at the same time. It needs a timer to bypass the monitoring when the compressor starts.

The disadvantage of all existing systems is their complexity. They do not directly address the protection of compressors against liquid refrigerant flooding, compressors crankcase heater malfunction and excessive superheat at the same time. Definitely their high cost limits their use to large expensive compressors only.

SUMMARY OF THE INVENTION

The present invention is intended to provide a reliable and low cost device for controlling and protecting the refrigeration systems against liquid refrigerant flooding, compressors crankcase heaters malfunction and excessive superheat.

The present invention consists of two temperature sensors positioned as follows:

A temperature sensor that measures the temperature just before compression, referred to as downstream temperature sensor.

Another temperature sensor that measures the temperature at the suction line, referred to as upstream temperature sensor.

A device that measures the difference in temperature between the two sensors and stops the compressor when the temperature difference drops to a predetermined or calculated temperature difference.

When the compressor is not running, or in case the crankcase heater is burned-out or malfunctioning, the downstream temperature sensor (installed near the crankcase heater) will be at the same temperature as the upstream temperature sensor (installed on the suction line of the compressor). Hence, in the absence of a temperature difference between the two sensors, the device will prevent the compressor from running.

In case the crankcase heater has not been energized before running the compressor for a certain time as normally recommended, the device will also prevent the compressor from running unless the temperature difference between the downstream temperature sensor and the upstream temperature sensor is 10° C. or more. The temperature difference setting depends on the heater thermal power and the ambient temperature around the compressor.

The device according to the present invention may also include an alarm, a two-digit superheat temperature digital display, a normal running status indicator, a defrost cycle triggering relay.

A PID regulator may be integrated to the device according to the present invention to control the electric expansion valve by monitoring the temperature difference of the same two sensors.

Definitions

The term "compressor", alone or in combination, means refrigeration compressor of any kind, centrifugal, reciprocating, scroll, screw, rotary.

The term "Downstream temperature sensor" alone or in combination and in conjunction with "Upstream temperature sensor", means a sensor installed near the crankcase heater, either fixed to the compressor body or in a well.

The term "Upstream temperature sensor" alone or in combination and in conjunction with "Downstream temperature sensor", means a sensor installed for convenience on the suction side of the compressor near the piton suction gas inlet, either fixed to the compressor body or in a well. But for best results and in case of an open compressor type it could be installed before the suction heat exchanger as indicated in FIG. 3.

The term "Crankcase heater" or "oil heater" alone or in combination, means an electric resistance in the oil sump of a compressor to mainly prevent the refrigerant from being diluted in the oil.

The term "Differential thermostat" alone or in combination, means a device with two thermal sensors.

The term "Liquid flood-back" alone or in combination, means a condition where liquid refrigerant is returned to the compressor, while only completely dry condition of the refrigerant gases should enter the compressor.

The term "Suction gas heat exchanger" alone or in combination, means a device used to minimize liquid flood-back and increase the system performance.

The term "Thermal expansion valve" alone or in combination, means a component in refrigeration and air conditioning systems that control the amount of refrigerant flow into the evaporator, thereby controlling the superheat at the outlet of the evaporator.

The term "Normal running conditions" means the conditions when the refrigeration system is working at the designed evaporation pressure and the designed condensation pressure.

The term "Normal running temperature difference" referred to as (NTD) means the temperature difference between the upstream temperature sensor and the downstream temperature sensor measured at normal running conditions of the refrigeration system. This temperature difference can be recorded by running the refrigeration or heat pump system and waiting till the temperatures and pressures stabilize at the operating point of the system.

The term "Unsafe temperature difference" referred to as (UTD) means the minimum temperature difference that is considered as still safe to keep the compressor running. In theory the temperature is zero, but in practice this temperature should be at least greater than the maximum error of the sensors and the comparator. In case of semi-hermetic and hermetic compressor working at low temperatures, the setting can be set around 10 degrees to minimize the exhaust temperature of the gases after compression.

The term "Defrost triggering temperature difference" referred to as (DTTD) means the temperature difference that is reached when the evaporator has accumulated a quantity of ice that is reducing its capacity by restricting the flow of air or the flow of the cooled medium. One way to find this set point is by visually looking at the amount of frost accumulated on the evaporator and recording the temperature difference when the amount is considered excessive. In an air to air heat-pump, this is reached when the ice is restricting the air flow.

The term "Alarm temperature difference" referred to as (ATD) means the minimum temperature difference that is set between the (DTTD) and the (UTD).

The term "Overheat temperature difference" referred to as (OTD) means the temperature difference that is greater than the normal temperature difference where the exhaust gas temperature is considered high enough to cause on the long term mechanical failures or oil cracking. It can be recorded by increasing the condensation temperature and at the same time decreasing the evaporation to their acceptable limits. This condition produces the highest exhaust temperature condition in normal use.

The term "Minimum time between two defrost cycles" referred to as (MTBD) means the time that is considered minimum between two defrost cycles. In general, for cold store and freezers it is a few hours, and for air to air heat-pump it can be less than one hour. In the present invention, this parameter is used to prevent two consecutive defrost cycles.

An additional definition for (NTD) as defined in paragraph "normal temperature difference" means the temperature difference range between (DTTD) and (OTD), this is the safe working range of the refrigeration system.

The term "time since last defrost cycle" referred to as (TSLD) means the time elapsed since the end of the last defrost cycle. It is calculated as of the end of defrost signal.

The term "Difference in Temperature" referred to as (DT) means the temperature difference measured by the device according to the present invention between the upstream temperature sensor and the downstream temperature sensor. It is the measure of the superheat between the two sensors, to be differentiated from the evaporator superheat or the total superheat.

The term "minimum temperature difference for a crank case heater" referred to as (MTDC) means the minimum temperature difference between the upstream and downstream sensors that should be sensed by the device according to the present invention in order to allow the compressor to start. This temperature difference depends on the position of the two sensors; a common value could be 15 degrees Celsius. It should be measured when the compressor is off for at least one hour, while the crankcase oil heater is energized and the compressor is in the coolest ambient temperature.

The term "extra heating time" referred to as (EHT) means the time delay to start the compressor after the (DT) has reached the (MTDC) value. This delay can vary from few seconds to one hour to ensure that the refrigerant diluted in the oil has evaporated completely.

The term "delay before checking parameters" referred to as (DBCP) means the time delay to start checking the parameters by the device according to the invention, except the (LITD) parameter. The (UTD) is checked when the compressor starts and is not subject to any delay. The (DBCP) time delay is used to ensure that the compressor has reached its steady state temperatures. This time delay can be set from few seconds to few minutes according to the system configuration. It can be obtained by running the refrigeration system and waiting till all the parameters stabilize.

The term "unsafe overheating temperature difference" referred to as (UOTD) means the temperature difference that is reached when the discharge temperature is close to the maximum acceptable. In general, this temperature is set for a particular refrigeration system when the low temperature is at its designed minimum and the condensing temperature is at its designed maximum.

The term (PID) is a control loop feedback mechanism (controller) commonly used in industrial control systems. A (PID) controller continuously calculates an error value as the difference between a desired setpoint and a measured process variable.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

FIG. 1, shows a convenient position of the sensors on a semi-hermetic compressor. The upstream temperature sensor is preferably installed on the suction line as far as possible from the compressor while preferably staying in the same ambient temperature of the compressor. In case the semi-hermetic compressor is equipped with a suction gas heat exchanger, the upstream temperature sensor is preferably installed upstream of the suction gas heat exchanger.

FIG. 2, shows a convenient positioning of the sensors on a hermetic compressor. The upstream temperature sensor is installed on the suction line as far as possible from the compressor while preferably staying in the same ambient temperature of the compressor.

FIG. 3, shows positioning of the sensors in an open compressor using a suction gas heat exchanger.

FIG. 4, shows a suction gas heat exchanger for compressors without crankcase and crankcase heater (i.e. open type screw compressors), prewired to be installed on the suction line.

FIG. 5, shows a miniaturized bypass with two sensors and a small heater to be connected to the invention device and to simulate a heat source. This setup is to be used specially for open compressors where a suction gas heat exchanger is not recommended. Only a portion of the gas stream will be heated. The position of the inlet is recommended to be after an elbow to collect effectively by centrifuge the liquid droplets. The heater could be an electric resistance of 20 Watts or less. Its power could be calculated to heat the diverted gas a maximum of 15° C.

FIG. 6, shows the definitions and the graphical presentation of the parameters used in the specification of the present invention.

FIG. 7, shows an example of a control algorithm for the present invention. It shows the definition of some variables used in the controller program and their sequence compared with the normal running temperature difference.

FIG. 8, is an example of controller settings depending on the type of compressor and the compressor working range.

FIG. 9, shows some examples of the possible position of the upstream and downstream temperature sensors. The evaporator superheat is what is measured by the expansion valve. Again all the temperatures can vary depending on the system configuration and system running conditions.

DETAILED DESCRIPTION OF PREFERRED EMBODIMENTS

The present invention will be further understood from the following description given by way of example only. The invention consists of two sensors positioned for example as shown in FIG. 1, FIG. 2, or FIG. 3.

A temperature sensor that measures the temperature just before compression, referred to as downstream temperature sensor.

Another temperature sensor that measures the temperature at the suction line, referred to as upstream temperature sensor.

A device that monitors difference in temperature (DT) between the two sensors and stops the compressor when the temperature difference drops to a predetermined set point (UTD).

The monitoring of the temperature difference of the refrigerant gas is made when the gas flows:

In case of semi-hermetic or hermetic compressor, the monitoring of the difference in temperature (DT) is when the refrigerant gas goes thru the compressor electrical motor and inside the compressor casing. When the compressor is equipped with a gas heat exchanger, the monitoring is made thru both of them.

In case of an open type compressor, the monitoring of the difference in temperature (DT) is thru a suction gas heat exchanger.

In the above two cases the temperature rise in normal operation between the two sensors can be beyond 35° C. for the hermetic and the semi-hermetic compressors (see FIG. 8), and beyond 10° C. for the suction gas heat exchanger. This increase in temperature depends on the system operating range, the electric motor efficiency and the refrigeration components selection.

In case of liquid flood-back to the compressor, the difference in temperature (DT) between the two sensors drops to zero. This is due to the fact that the heat added to the gas stream is evaporating the liquid droplets instead of heating the gas. As long as there are liquid droplets in the gas stream, the gas temperature will not rise between the two sensors. This substantial variation in temperature, up to 30° C. or more, occurring between the desired dry refrigerant gas condition, and a liquid floodback condition (i.e. wet refrigerant gas condition containing non evaporated liquid to the compressor), can be easily detected due to the drastic change in temperature between the two states.

All the embodiments have in common two sensors separated by a substantial heat source preferably inherent to the system. The difference in temperature (DT) is monitored by the device according to the present invention to detect the saturation condition of the gas at the downstream sensor. This sensor is installed close to the internal suction port of the compressor.

The first embodiment consists of a device with one level of temperature difference including a relay that will shutdown the compressor when the difference in temperature (DT) drops to the (UTD) value. This is the simplest embodiment.

A second embodiment is adding a second level of temperature difference including a relay that will send an alarm when the difference in temperature (DT) drops to the (ATD) value.

A third embodiment is adding a third level of temperature difference including a relay that will send an alarm when the difference in temperature (DT) reaches the (OTD) value. This excessive superheat could indicate in general a low refrigerant charge, a thermal expansion valve malfunction or any restriction on the refrigerant circuit.

A fourth embodiment is adding a fourth level of temperature difference including a relay that starts a defrost cycle when the difference in temperature (DT) reaches the (DTTD) value. This embodiment is useful in refrigeration and in heat pump systems.

A fifth embodiment is adding a fifth level of temperature difference including a relay that signals a safe operation of the compressor when the difference in temperature (DT) ranges between (DTTD) and (OTD) values.

A sixth embodiment is adding a sixth level of temperature difference including a relay that stops the compressor when the difference in temperature (DT) reaches the (UOTD).

For an open compressor with a crankcase and an oil heater. See FIG. 3. In order to be able to use the same device according to the invention, a heating source is needed to replace the heat dissipated by the electric motor. Normally a suction gas heat exchanger can increase the suction gas temperature by at least 5° C. at running design conditions.

For open compressors without crankcase (like open screw compressors, with an external oil separator and oil tank and an external oil heater), a prewired suction gas heat exchanger with the downstream temperature sensor and a small heater at one end, and the upstream temperature sensor at the other end could be used. See FIG. 4. This small heater will provide the necessary temperature difference to allow the compressor to start. It can eventually be replaced by a timer to bypass the controller imbedded in the device according to the present invention for a certain time (DBCP, to ensure that the temperature between the two sensors reaches its normal running value after the compressor starts). The timer has the same function as the one used in the oil differential controller for protecting the refrigeration compressors in case of lubrication failure. The heater alternative gives better results than a timer, because in case there is a liquid flood-back to the compressor, the temperature will drop quickly and the controller will stop the compressor without delay. If a timer is used, the controller will have to wait till the end of the timer to stop the compressor.

This same embodiment can be used for a cooling system where an additional superheat due to the use of the suction gas heat exchanger is not recommended (i.e. cooling system in a car). The compressor in a car is subject to high evaporation and condensation temperatures. To overcome this limitation, a bypass can be installed in parallel to the main suction gas pipe, see FIG. 5. This will reduce the superheat compared to a full flow suction gas heat exchanger and enables the use of the embodiment of the present invention. Note that the electric resistance is installed next to the downstream sensor to create enough temperature difference to avoid the use of a start-up timer as explained above.

For all above embodiments except the first one that stops the compressor, it is preferable to add a timer for each embodiment, or one general timer for all. The purpose of this timer is to provide a delay after the compressor starts, to suspend the difference in temperature (DT) monitoring. This will ensure that the monitoring for all other embodiments starts when the system is running at normal running conditions. Each timer can be adjustable from few seconds to few minutes depending on the refrigeration system configuration. This is very simple to implement using a microcontroller such as Siemens Logo 8 series. See FIG. 7. In this algorithm one general timer is used.

Examples of more sophisticated controller responses are:

If the difference in temperature (DT) has not reached the set temperature for compressor cutoff (UTD), but the temperature is decreasing at a fast rate (e.g. one degree per second), it stops the compressor.

If the difference in temperature (DT) is persistent for a long time close to the (UTD) (e.g. 5 minutes at 5% above set temperature), it stops the compressor.

This can be easily programmed using a microcontroller such as Siemens Logo 8 series or an OEM microcontroller embedded in the device. All these parameters could be adjustable for a specific compressor model working in a specific refrigeration range.

An extra embodiment to control the expansion valve in a single evaporator system, can be included in the setup shown in FIG. 4. Suction gas heat exchanger for compressors w/o crankcase. A (PID) circuit using the same two temperature sensors can be added to the device according to the present invention to control the expansion valve by maintaining a temperature difference between the two sensors, close to the (NTD) (the normal temperature difference across this device).

The extremely low pressure drop of the gas stream across the suction heat exchanger gives a better result for controlling the expansion valve than measuring the superheat across the evaporator using two thermal sensors, one at the evaporator inlet and one at the evaporator outlet. The substantial pressure drop across the evaporator decreases the accuracy of the evaporator superheat reading.

This is the reason why in order to determine exactly the superheat across the evaporator to control an electric expansion valve, a pressure sensor is normally used near the temperature sensor at the evaporator exit, or in case of a mechanical thermal expansion valve, a pressure equalizer line is used.

All above embodiments can be integrated in one device with one single power supply and a microcontroller with two analogue inputs, one for each thermal sensor, and multiple outputs one for each selected embodiment. Also the device can be fitted with two digit LED display to indicate the difference in temperature (DT). A more sophisticated display can be programmed by the microcontroller to show all the parameters in sequence and alarms status. Also a log of all the last events with a time stamp can be either scrolled or downloaded.

FIG. 7 shows an example of a control algorithm for the proposed invention. The programmable controller will first check if the compressor is off. In this case, the device according to the present invention checks if the difference in temperature (DT) (the measured temperature difference), is higher than the (MTDC) (the minimum temperature difference that a running crankcase heater should bring between the two sensors when the compressor is not running).

If the difference in temperature (DT) is not higher than (MTDC), the relay to stop the motor will be kept in its off position for a predetermined time i.e. 10 minutes. If (DT) is higher than (MTDC), the controller program will be directed to the program start.

If the compressor has started, the controller will immediately start checking if the difference in temperature (DT) is greater than the (UTD), if not, the controller will shut down the compressor immediately for a certain time i.e. 5 minutes. If (DT) is greater than the (UTD), the controller will start (DBCP) delay timer and will wait for this timer to end. Meanwhile the controller will keep checking if (DT)> ((UTD).

Once the (DBCP) timer is over, the controller will check if (DT) is greater than the (OTD), in this case, the controller will signal a high superheat alarm, and can also shutdown the motor if desired. If (DT) is less than (OTD), the controller will check if the (DT) is greater than the (DTTD) (the defrost triggering temperature difference). In case (TDT) is less than (OTD) the controller will indicate that the system is running normally.

If the difference in temperature (DT) is less than (DTTD), the controller will check if the (DT) is greater than the (ATD) (alarm temperature difference), if Yes it will check if the (TSLD) (Time since last defrost) is greater than the (MTBD) (minimum time between two consecutive defrost cycles) if Yes, it will trigger a new defrost cycle.

If the difference in temperature (DT) is less than the (ATD) (the alarm temperature difference) the controller will check if the (DT) is greater than the (UTD) (indicating a dangerously low superheat). If Yes, it will trigger an alarm indicating a dangerously low superheat. If No, it will shutdown the compressor.

All parameters are adjustable, depending on the compressor type, working range and the temperature sensor positions. The difference in temperature (DT) can be set as a function of the incoming gas temperature measured by the upstream temperature sensor. To make the setting of the parameters easier, a two-digit display could be added to the device according to the present invention to show the measured temperature difference. Once the refrigeration system has reached its normal running conditions, the temperature can be recorded and used for setting up all setpoints as shown in the legend of FIG. 6.

A short way to adjust the set point for the different temperatures (UTD), (DTTD), (ATD), as defined in paragraphs above, is to divide the (NTD) into four equal parts in order to maximize the gap between each setting. The (UTD) can be set at 25%, the (ATD) at 50% and the (DTTD) at 75% of the (NTD) value.

In case the refrigeration system is not equipped for a defrosting cycle, the (NTD) can be divided into three equal parts. The (UTD) can be set at 33% and the (ATD) at 66% of the (NTD).

With the same logic, the (OTD) can be set at 125% of the (NTD) value and the (UOTD) can be set at 150% of the (NTD) value.

With system observation these percentages values can be fine-tuned by the manufacturer by following the setting recommendations as explained in paragraphs above.

Moreover, the (UTD) and the (UOTD) can be replaced by timers that will stop the compressor if the corresponding alarms (ATD) and (OTD) persist for i.e. 5 minutes.

FIG. 8 summarizes all discussed parameters settings at different ranges (Air conditioning, cold storage and freezer) using semi-hermetic compressors fitted with different electric motor efficiencies. Still for optimum performance, these values should be checked by bench testing the refrigeration machine.

For better regulation for large compressors, a low precision pressure sensor can be added in order to change the set point according to the suction pressure that defines the working range of the compressor (High pressure, medium pressure or low pressure) equivalent to (Air-conditioning range, cold-storage range or freezer range).

In both cases, whether the temperature or the pressure sensors are used, their primary function is to detect whether the compressor is working in the freezer range where the temperature difference is expected to be high, or in the cold storage range where the temperature difference is expected to be medium, or in the air conditioning range where the temperature difference is expected to be minimal.

In any case all setting points should be based on actual measurements of the refrigeration system running at design temperatures.

The temperature difference, especially in case of hermetic compressors, is difficult to predict due to the gas flow passageways and compressor internal configuration. Each compressor model should be tested at normal running conditions and the normal running temperature difference should be recorded.

Furthermore, the sensor's position on the compressor can also be optimized depending on compressor models. Especially in hermetic compressors, where the downstream temperature sensor can be factory installed close to the piston inlet valve.

In order to have a reliable non drift measurement system, the temperature difference can be measured by two temperature sensors connected in a one Wheatstone bridge configuration, or by using two thermocouples connected in series.

Advantages Compared to Prior Art

Protection against liquid flooding by detecting liquid in the refrigerant gas downstream of all heat producing components (i.e. electric motor in case of hermetic and semi-hermetic compressors, piston body in case of hermetic compressors, and suction gas heat exchanger, in case of an open compressor). All those heat producing components are capable of evaporating a great amount of liquid and protect the compressor in case there is not much liquid in the gas stream. This will prevent frequent non-critical compressor shutdown in comparison to a system that checks the gas condition upstream of the compressor.

Simple and accurate detection of liquid floodback with a device consisting of two temperature sensors with one comparator and one relay. There is no need for sophisticated electronics and start-up timers. The cost can be so low, that it can be installed even on the cheapest small compressors.

The main measurement is differential using two thermocouples or any two thermal sensors installed in a single Wheatstone bridge. A differential measurement is less prone to drift with time.

In case a pressure sensor and a temperature sensors are used to measure the refrigerant gas superheat, the pressure sensor should be capable to measure with a precision of 0.1 bar and yet should be capable to resist a pressure up to 20 bars and at varying temperatures from −40 to +20° C. without drift with time. The total error is the sum of the errors coming from the pressure sensor, the error coming from the temperature measurement, and the error from the pressure temperature saturation table or function.

No need for periodic calibration. In the device according to the present invention the main temperature measurement is a temperature difference, known to be very stable with time.

No need for expensive temperature sensors, or expensive electronic comparators. One or two degrees' Celsius error in the measurement will not reduce the effectiveness of the protection feature of the device.

The device according to the present invention runs with different refrigerants without having to input refrigerant saturated pressure-temperature tables, or refrigerant saturated pressure-temperature function. This is due to the fact that the saturation condition is depicted if the difference in temperature (DT) is zero.

This is true for any refrigerant either single component or a mixture.

The device according to the present prevents the compressor from running in case of crankcase heater failure. One protection device even in its simplest embodiments is protecting the compressor against liquid return to the compressor and crankcase heater malfunction. By judiciously installing the two sensors, and in case there is no temperature difference between the two sensors when the compressor is not running due to the crankcase heater failure. The device will prevent the compressor from running.

It is even possible to use a mechanical differential thermostat, like the mechanical mechanism used in the Trafag DTS 391, and to embed it inside the compressor. In this case no need for electrical power to run the device. This is similar to the mechanical thermal protection installed on most compressors to protect the electrical motor coil, and in some mono-phase compressors, the electric contact is in series with the motor coil, and all is wired inside the compressor.

The device according to the present invention can be used to trigger the defrost cycles much more efficiently since the invention device is monitoring the result of the ice buildup. Usually, a defrost cycle is triggered:

By a clock independently of the system condition. In this case many defrost cycle will be triggered early or too late. The clock or fixed timer is used very often in refrigerators and freezers.

By a low evaporation pressure pressostat based on the low pressure which is not always an indication to start a defrost cycle. Because the low pressure could be due to a low fluid temperature thru the evaporator or a low refrigerant charge.

By an ice thickness controller, knowing that the ice thickness could be uneven and the ice thickness can give an erroneous indication to trigger a defrost cycle.

The device according to the present invention can detect an excessive superheat condition and can send an alarm or even shutdown the compressor, if desired. The compressor shutdown can be set at a higher superheat condition than the alarm set point, or by using a timer if the alarm condition persists for more than a certain predetermined time. (i.e. 5 minutes).

This is an added protection to the discharge temperature and motor winding temperature protections which are, in almost all compressors, installed with a fixed setting. The setting is fixed at the maximum temperature that either the compressor discharge valve, refrigerant oil or the electric motor winding can tolerate. In the device according to the present invention the (OTD) value is adjusted according to the refrigeration system designed operating temperatures. In most cases the refrigeration system designed operating temperatures are lower than the maximum operating temperatures of the compressor. Using the parameters of the system designed operating temperatures will give the opportunity to send an alarm or even shut-down the compressor before reaching excessive temperatures at the discharge valve or at the motor windings. For example, the same semi-hermetic compressor can be used in a freezer system and in a chiller system. The discharge temperature and motor winding protection are set by the manufacturer at the freezer operating temperatures, in general more than 120° C. When the compressor is used as a chiller the discharge temperature can be set less than 100° C., and in case the temperature exceeds 100° C., this means that there is something wrong with the system and the system should be checked.

The device according to the present invention can extend the low temperature range of compressors, especially the hermetic and semi hermetic compressors. When the compressor is working at low evaporation temperature, thus at low evaporation pressure and reduced mass flow of refrigerant (to cool-down the electric motor), a high superheat will increase dangerously the discharge temperature and the electric motor winding temperature. By controlling the superheat near the inlet valve of the piston, the superheat can be minimized. A low superheat will decrease the discharge temperature and the motor winding temperature. To get the benefit of this feature, the embodiment with a PID to control the expansion valve should be used.

INDUSTRIAL APPLICATIONS

This invention can be mainly used in refrigeration and heat pump systems. Examples of refrigeration systems are:

Refrigerators
Split system air conditioners, cooling and heat pump
Chillers
Cold stores and freezers
Blast coolers and blast freezers
Water coolers and ice making machines
Car air conditioning systems It is to be understood that the specific embodiments of the invention that have been described are merely illustrative of certain applications of the principle of the present invention. Numerous modifications may be made to the present instruments and methods described herein without departing from the spirit and scope of the present invention.

The invention claimed is:

1. A multi-functional refrigeration system protection device comprising a sensor that measures the temperature of a refrigerant gas after a passage thru an electric motor and just before its compression, a sensor that measures the temperature of the refrigerant gas at a compressor inlet before its passage thru the electric motor, a controller that determines the difference in temperature (DT) between the two sensors and generates one or more signals to perform the following one or more function: stopping a compressor due to liquid refrigerant presence beyond the electric motor or faulty oil heater, triggering a pre-alarm or an excess superheat alarm, starting a defrost cycle, generating a signal to indicate that the system is running safely and controlling an electronic expansion valve in one compressor-one evaporator systems, characterized by the fact that detection of refrigerant liquid presence is not performed on a suction line before the compressor inlet where some liquid can still be evaporated when cooling the electric motor without it representing a risk to the compressor, and by the fact that both sensors can be installed in a compressor body and factory pre-wired and tested.

2. A refrigeration system protection device according to claim 1 configured to generate a signal to stop the compressor in case the difference in temperature (DT) is less than 25% of the normal running temperature difference (NTD).

3. A refrigeration system protection device according to claim 1 configured to generate a signal to trigger an alarm in case the difference in temperature (DT) ranges between 25% and 50% of the normal running temperature difference (NTD).

4. A refrigeration system protection device according to claim 1 configured to generate a signal to trigger a defrost cycle in case the difference in temperature (DT) ranges between 50% and 75% of the normal running temperature difference (NTD).

5. A refrigeration system protection device according to claim 1 configured to generate a signal to trigger a superheat alarm in case the difference in temperature (DT) ranges between 125% and 150% of the normal running temperature difference (NTD).

6. A refrigeration system protection device according to claim 1 configured to generate a signal to stop the compressor in case the difference in temperature (DT) is greater than 150% of the normal running temperature difference (NTD).

7. A refrigeration system protection device according to claim 1 configured to generate a signal to indicate that the system is running safely if the difference in temperature (DT) ranges between 75% and 125% of the normal running temperature difference (NTD).

8. A refrigeration system protection device according to claim 1 configured to generate a signal to stop the compressor in case the difference in temperature (DT) is less than an unsafe temperature difference (UTD).

9. A refrigeration system protection device according to claim 1 configured to generate a signal to trigger an alarm in case the difference in temperature (DT) ranges between an alarm temperature difference (ATD) and an unsafe temperature difference (UTD).

10. A refrigeration system protection device according to claim 1 configured to generate a signal to trigger a defrost cycle in case the difference in temperature (DT) ranges between a defrost triggering temperature difference (DTTD) and an alarm temperature difference (ATD).

11. A refrigeration system protection device according to claim 1 configured to generate a signal to trigger a superheat alarm in case the difference in temperature (DT) ranges between an overheat temperature difference (OTD) and an unsafe overheat temperature distance (UOTD).

12. A refrigeration system protection device according to claim 1 configured to generate a signal to stop the compressor in case the difference in temperature (DT) is greater than an unsafe overheat temperature distance (UOTD).

13. A refrigeration system protection device according to claim 1 configured to generate a signal to indicate that the system is running safely if the difference in temperature (DT) ranges between an overheat temperature difference (OTD) and a defrost triggering temperature difference (DTTD).

14. A device for controlling an electronic expansion valve comprising a PID controller and a refrigeration system protection device according to claim 1, by maintaining a difference in temperature (DT) close to a normal running temperature difference (NTD).

15. A refrigeration or heat pump system comprising a device according to claim 1.

* * * * *